United States Patent [19]

Huber

[11] Patent Number: 4,963,116

[45] Date of Patent: Oct. 16, 1990

[54] RACE WATER TRACK TOY

[76] Inventor: John J. Huber, 1614 S. Magnolia, Broken Arrow, Okla. 74012

[21] Appl. No.: 419,214

[22] Filed: Oct. 10, 1989

[51] Int. Cl.[5] ..... A63H 29/10; A63H 23/00; A63G 3/00; A63F 9/14

[52] U.S. Cl. ..... 446/176; 446/153; 272/1 R; 272/32; 273/86 R

[58] Field of Search ..... 446/153, 176, 156, 157, 446/158, 159, 160, 163, 164; 272/1 R, 1 B, 32, 565 R; 273/86 D, 86 R

[56] References Cited

U.S. PATENT DOCUMENTS

| | | | |
|---|---|---|---|
| 419,860 | 1/1890 | Libbey | 446/153 X |
| 930,613 | 8/1909 | Pressey | 446/153 X |
| 1,389,611 | 9/1921 | Wood et al. | 273/86 D |
| 1,580,046 | 4/1926 | Jones, Jr. et al. | 273/86 D |
| 1,624,282 | 4/1927 | Russell | 446/153 X |
| 1,720,707 | 7/1929 | Woodard | 273/86 D |
| 1,872,074 | 8/1932 | De Witt | 273/86 D |
| 2,604,055 | 7/1952 | Snowden | 273/86 D |
| 2,686,389 | 8/1954 | Rozell | 273/86 D |
| 3,339,924 | 9/1967 | Costagliola | 273/86 D |
| 3,363,268 | 1/1968 | Friedlander | 272/1 B |
| 4,209,935 | 1/1980 | Parker | 273/86 D |
| 4,805,898 | 2/1989 | Jacober et al. | 272/56.5 R |

FOREIGN PATENT DOCUMENTS

| | | | |
|---|---|---|---|
| 909382 | 5/1996 | France | 446/153 |
| 432516 | 3/1948 | Italy | 273/86 D |
| 1587277 | 4/1981 | United Kingdom | 446/153 |

*Primary Examiner*—Robert A. Hafer
*Assistant Examiner*—D. N. Muir
*Attorney, Agent, or Firm*—Head and Johnson

[57] ABSTRACT

A circumferential trough provides a water carrying channel, and has at least one water jet in the trough to which a supply of water under pressure is connected to produce a flow of water in the trough into which floating objects may be placed.

13 Claims, 1 Drawing Sheet

RACE WATER TRACK TOY

SUMMARY OF THE DISCLOSURE

Children enjoy playing with floating objects, and particularly objects which can be caused to move on water. Others have provided facilities for playing with floating objects, and for background reference to such prior known devices, reference may be had to the following U.S. Pat. Nos. 943,575; 2,032,192; 3,509,584 ; 3,363,268; 4,235,375; and 4,515,360.

The present disclosure is a race water track toy The invention may be utilized in a number of different forms. The track can be laid out on a lawn and can be designed so that portions can be linked together to form a variety of lengths and shapes. The track can be designed with flotation so it can be floated on the surface of a swimming pool, or the track can be incorporated as a part of an improved children's swimming pool. The water track toy is in the form of a circumferential trough providing a continuous water carrying channel.

A supply of water under pressure, such as from a flexible garden hose, is connected to the trough. At least one water jet is formed in or directed into the water trough so that when water under pressure is connected to the jet, water in the channel is caused to flow circumferentially around the track. Floating objects may be placed in the channel, which are carried by the flowing water around the track.

In a different embodiment, the water channel is in the form of two parallel circumferential troughs. Water jets are provided to direct water into both troughs so that floating objects may be placed into either or both of the troughs. Such arrangement provides facilities for racing of object in the two parallel water carrying troughs.

For a better understanding of the invention, reference may be had to the following description and claims, taken in conjunction with the attached drawings.

DESCRIPTION OF THE PREFERRED EMBODIMENT

The race water track toy of this disclosure may be used in a number of ways. In its basic application a circumferential track can be placed on a lawn, with a supply of water pressure connected to the track. The track can be made in connectable lengths so that varying total length tracks can be assembled.

The track may include various patterns so that planes, loops and jumps may be included.

In another embodiment, the track may include floatation so that if can be floated on top of the water in a swimming pool.

While all of these different applications are applicable to different environments in which the invention is patentable, an unique way of practicing the invention is as a part of a swimming pool. The invention will be described with reference to this manner of practicing the invention, with the understanding that the invention is not limited to this embodiment which is used for purposes only.

Figure 1:
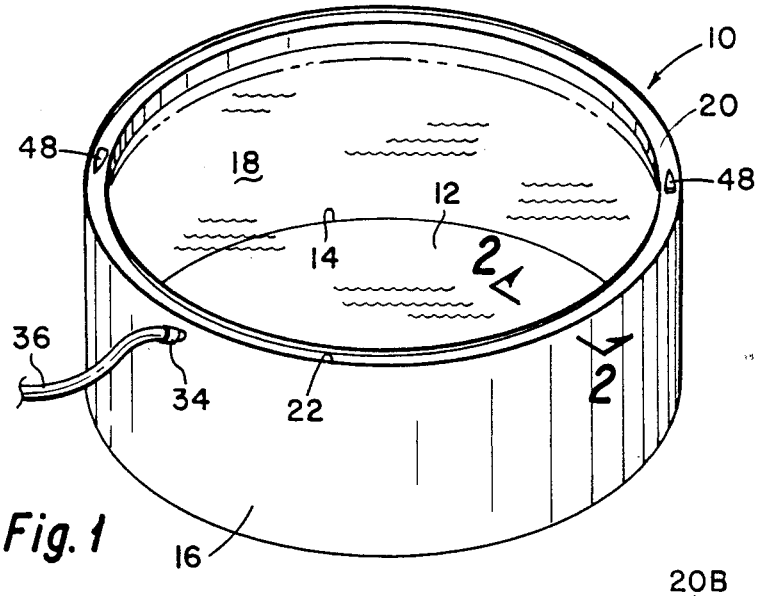
FIG. 1 is an isometric view of a children's swimming pool showing one embodiment for employing the race water track toy of this disclosure. The track is connected to a supply of water under pressure.

Referring to the drawings and first to FIG. 1, a swimming pool is generally indicated by the numeral 10. The pool includes a horizontal bottom 12 and, extending from the bottom upwardly therefrom, a circumferential side wall 16. The pool is shown of circular plan view, however, this shape is merely optional as the pool can be oblong, generally rectangular or of other desired shapes.

The pool 10 can be formed of plastic mateial with the side wall 16 sufficiently rigid to retain a quantity of water 18 in the pool to provide a playing area for children. The depth of the pool is limited by the height of the side wall 16. The pool described to this point is typical of inexpensive portable swimming pools for small children. It is generally not intended to be deep enough or big enough for actual swimming but in which children can stand or sit and play in water 18.

The improvement of this disclosure includes the provision of a circumferential trough, generally indicated by the numeral 20, at the upper circumferential edge 22 of side wall 16.

The trough 20 may be supported to or formed with the upper edge of the swimming pool side wall 16. In the manner illustrated in FIG. 2, the pool side wall 16 forms one side of trough 20. An opposed trough side wall 24, which is spaced from the pool side wall 16, forms the trough. A bottom 26 which extends from side wall 16 to the trough side wall 24 completes the trough. The trough side wall 24 has an upper edge 28 which preferably is approximately the same height as the pool side wall upper edge 22, although the upper edge 28 may be slightly lower so that spillage of water from the trough will spill into the interior of the pool rather than to the exterior.

The pool side wall 16, trough side wall 24, and trough bottom 26 may be formed of rigid or semirigid plastic. In the embodiment illustrated, at least the trough bottom 26 is formed of flexible plastic and is of double thickness, providing a bottom upper portion 30 which is more or less parallel to the trough bottom 26. A circumferential envelope area 32 is thereby formed between the trough bottom 26 and the upper portion 30. By means of a fitting 34 (see FIG. 1) which has the inner end of communication with the circumferential envelope area 32, and to which water hose 36 is attached, the envelope area 32 may be filled with water under pressure to thereby cause expansion of the envelope area to form the bottom of trough 20.

To cause water to flow in the trough, a jet of water is directed into the trough. One means of accomplishing this is jet member 38 formed in the trough bottom upper portion 30 having a passageway 40 therethrough. Water from the circumferential envelope area 32 flows through passageway 40 into the interior of channel 20. The jet member 38 is orientated such that the ejection of water through passageway 40 is inclined at an acute angle with respect to the trough bottom upper portion 30, that is, in a direction to cause water 42 within the trough to flow. As long as water pressure is supplied by hose 36 through jet member 38, the channel of water 42 within trough 20 will flow in a circumferential manner.

The trough naturally will fill and overflow, and if the upper edge 28 of the trough side wall 24 is lower than the upper edge 22 of the pool side wall 16, the water overflow will be into the pool so that thereby the pool can be filled and, after being filled, will be replenished with fresh water as the trough overflows.

Figure 5:
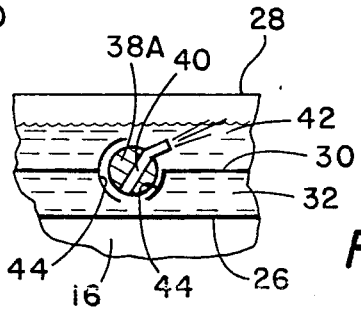
FIG. 5 is a fragmentary elevational cross-sectional view as in FIG. 4, showing the water jet of FIG. 4 in an improved embodiment in which the jet is pivotally supported in the bottom of the trough and is adjustable so that the angle of discharge of water through the jet relative to the trough bottom can be adjusted.

FIG. 5 shows an alternate embodiment of the jet manner 38A in which the jet member is positionable with respect to the bottom upper portion 30. This can be accomplished by use of a spherical member which is rotatably received in socket 44, formed in the bottom upper portion 30. With an adjustable jet member 38A, the angle of discharge of the water can be adjusted by the user to produce the maximum rate of flow of water in the trough.

Figure 2:
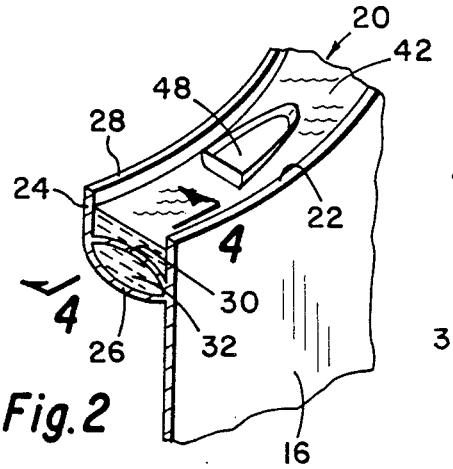
FIG. 2 is a fragmentary cross-sectional view taken along the line 2—2 of FIG. 1, showing the circumferential trough forming the race water track.
Figure 3:
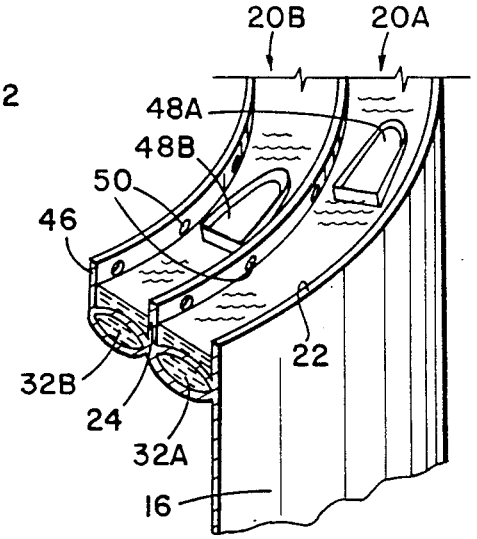
FIG. 3 is a cross-sectional view as in FIG. 2 but showing the provision of two parallel circumferential troughs for forming the track.

FIG. 3 shows an alternate embodiment of the disclosure, including a first trough 20A and a second trough 20B which are parallel and adjacent to each other, and each of which circumferentially inscribes the top of the swimming pool. The second trough 20B is formed by a second trough side wall 46 which is spaced from and parallel to the first trough side wall 24. The second trough 20B has a bottom arrangement as described with reference to FIG. 2. Although not shown in FIG. 3, the bottom of the second trough 20B has one or more jet members therein so that water under pressure is supplied to cause a circumferential moving flow of water in the second trough 20B. A passageway (not shown) is provided between the first circumferential envelope area 32A and the second circumferential envelope area 32B of FIG. 3, so that a source of water pressure is available for each trough 20A and 20B.

The arrangement of FIG. 3 provides an increased opportunity for entertainment for children using the swimming pool 10. As shown in FIG. 2, a floating object 48 may be placed in the channel 20 which will be carried around by the circumferentially flowing channel of water. In FIG. 3, a floating member 48A may be placed in channel 20A and another floating member 48B in channel 20B so that both floating objects are carried around by the flowing channels of water, and, therefore, races can be had between the two floating objects. By the use of adjustable jet members 38B, as shown in FIG. 5, the users can challenge each other by adjusting the water jets to produce maximum speed of current flow of the water channels.

As shown in FIG. 3, the first trough side wall 24 and the second trough side wall 46 may each be provided with holes 50 therein. This allows water to pass from first trough 20A into second trough 20B and from the second trough 20B into the interior of the swimming pool. This arrangement allows the water used to produce flowing action in the trough to enter the swimming pool without flowing over the top of the trough wall edges.

Figure 4:
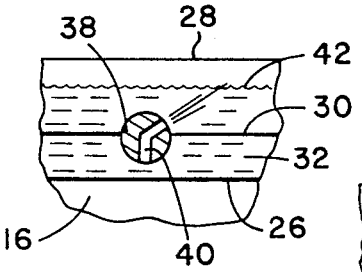
FIG. 4 is a fragmentary elevational cross-sectional view as taken along the line 4—4 of FIG. 2, showing a water jet formed in the bottom of the trough.

At least one water jet of the type shown in FIG. 4 or FIG. 5 is required for each channel, however, more than one water jet may be and preferably is required to produce a relatively high speed circumferential flow of water. The water jets 38 or 38A may be spaced equally distances apart from each other around the water channel.

Instead of the jets extending into the troughs from the bottom, the jets may extend from the trough said walls, or be supported above the troughs for discharge of water into the troughs.

In order to vary the racing conditions where two or more paralleled troughs are employed, the walls between adjacent troughs can be supplied with gates (not shown) which can be opened to permit water to flow between the troughs.

As previously stated, the practice of the race water track toy as a part of a swimming pool is for purposes only of exemplifying one unique application of the invention while the invention may be utilized in a number of different ways.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A water track toy comprising:

a trough member providing a continuous elongated water carrying channel, one elongeted portion is said channel being formed of an envelope of thin plastic material, said envelope comprises a closed tubular portion extending the length of the channel;

means to direct a supply of water pressure into said trough to produce flow of water in said trough into which floating object may be placed; and means of connecting water under pressure to expand said envelope to form a structural portion to at least in part support said trough portion.

2. A water track toy according to claim 1 wherein said trough is formed of paralleled first and second trough portions and wherein said means of directing a supply of water under pressure includes means to supply water to both said first and second troughs.

3. A water track toy according to claim 7 including at least one jet member supported to said trough, the jet member having an inlet end and an outlet end, the outlet end being within said trough and wherein said means of directing of supply of water under pressure to said troughs includes connecting such supply water at least in part to the inlet end of said jet member.

4. A water track toy according to claim 1 including at least one jet member supported to said trough member, each jet member having an inlet end and an outlet end, the outlet end being within said channel and wherein said means to direct a supply of water under pressure into said trough includes at least in part connecting a supply of water to the inlet end of each said jet member.

5. A water track toy according to claim 1 including;

a children's swimming pool in the form of a vessel having a bottom and circumferential said walls extending upwardly therefrom, the side walls having an upper edge, and wherein said though member is supported to said upper edge whereby said trough forms a continuous water carrying channel around said vessel upper edge.

6. A water track toy comprising:

a trough member providing a continuous elongated water carrying channel;

a water carrying envelope contiguous to at least a substantial portion of said water carrying channel, the envelope being separated from said channel by a common wall, said envelope comprises a closed tubular portion extending the length of the channel;

means of connecting a source of water under pressure to said water carrying envelope to expand said envelope to form a structural portion to at least in part support said water carrying channel;

at least one directionally controllable jet member in said common wall for directing the flow of water from said envelope into said channel.

7. A water track toy according to claim 6 wherein said common wall has a socket therein and wherein said jet member is in the form of a spherical member having a passageway therethrough.

8. A water track toy according to claim 6 wherein said trough is formed of paralleled first and second trough portions and wherein said water carrying envelope is contiguous to at least a substantial portion of both track portions.

9. A water track comprising:

a children's swimming pool in the form of a vessel having a bottom and circumferential sidewalls extending upwardly therefrom, the sidewalls having an upper edge;

a circumferential trough member providing a continuous elongated water carrying channel supported to said vessel sidewalls upper edge whereby the trough forms a continuous water carrying channel around said vessel upper edge; and said trough member supported by a continuous closed tubular envelope extending beneath the trough along its length;

means to direct water under pressure into said envelope thence through to the trough to produce a flow of water in said trough into which floating objects may be placed.

10. A water track according to claim 9 including at least one jet member supported to said trough, the jet member having an inlet end and an outlet end, the outlet end being within said trough and wherein said means to direct water under pressure includes means of connecting a supply of water to the inlet end of said jet member.

11. A water track according to claim 9 wherein said trough is formed of paralleled first and second trough portions and wherein said means to direct water under pressure includes means to supply water to both said first and second troughs.

12. A water track according to claim 11 including at least one jet member supported to each of said trough portions, each jet member having an inlet end and an outlet end, the outlet end of each jet member being within a said trough portion and wherein said means to direct water under pressure to said first and second troughs including means of connecting a supply of water to the inlet end of each of said jet members.

13. A water track according to claim 9 wherein at least a portion of said trough member is formed of an envelope of thin plastic material; and means of connecting water under pressure to expand said envelope to form a structural portion to at least in part support said trough portion.

* * * * *